US009752575B2

(12) United States Patent
Vertenoeuil

(10) Patent No.: US 9,752,575 B2
(45) Date of Patent: Sep. 5, 2017

(54) TWO STAGE PUMP, PARTICULARLY PROVIDED AS MAIN PUMP FOR SUPPLYING AN AIRCRAFT ENGINE WITH FUEL

(71) Applicant: SNECMA, Paris (FR)

(72) Inventor: Philippe Vertenoeuil, Paris (FR)

(73) Assignee: SNECMA, Paris (FR)

( * ) Notice: Subject to any disclaimer, the term of this patent is extended or adjusted under 35 U.S.C. 154(b) by 229 days.

(21) Appl. No.: 14/750,121

(22) Filed: Jun. 25, 2015

(65) Prior Publication Data

US 2015/0377235 A1 Dec. 31, 2015

(30) Foreign Application Priority Data

Jun. 26, 2014 (FR) ..... 14 55988

(51) Int. Cl.
*F04C 11/00* (2006.01)
*F04D 13/12* (2006.01)
(Continued)

(52) U.S. Cl.
CPC ..... *F04C 11/005* (2013.01); *F02M 37/041* (2013.01); *F04C 2/084* (2013.01);
(Continued)

(58) Field of Classification Search
CPC ..... F04C 11/005; F04C 11/006; F04C 2210/1044; F04C 2/18; F04C 15/0061;
(Continued)

(56) References Cited

U.S. PATENT DOCUMENTS 2,688,925 A * 9/1954 Thoren ..... F02M 17/18 417/203
2,726,604 A * 12/1955 Aspelin ..... F04C 11/005 417/203
2,767,658 A * 10/1956 Murray ..... F04D 13/02 417/203
2,870,719 A * 1/1959 Murray ..... F04B 23/12 384/208
(Continued)

OTHER PUBLICATIONS

French Preliminary Search Report issued Mar. 20, 2015 in French Application 14 55988, filed on Jun. 26, 2014 (with English Translation of Categories of Cited Documents).

*Primary Examiner* — Mark Laurenzi
*Assistant Examiner* — Xiaoting Hu
(74) *Attorney, Agent, or Firm* — Oblon, McClelland, Maier & Neustadt, L.L.P.

(57) ABSTRACT

A two stage pump (2', 4'), where the high pressure stage (4') is a gear pump (11, 12), comprises a driving of the other stage (2') by a support shaft (74), mounted in the driven pinion (12), the shaft (74) being driven by the drive shaft (21), by means of a pair of toothed wheels (77, 79) adjacent to the rest of the stage (4'), which can allow different rotation speeds between the two stages (2', 4'). The support shaft (74) may be supported by stops and hydrodynamic bearings, directly integrated and lubricated in the driven pinion, which make the design lighter and more compact. The shaft (74) and the toothed wheels (77, 79) ingeniously transmit the loads from the stage (2') to the stage (4') in such a way as to cancel out the usual hydraulic loads, stemming from pressure, and mechanical, forces stemming from rotational drivings on the driven pinion (12).

13 Claims, 3 Drawing Sheets

(51) Int. Cl.

| | |
|---|---|
| ***F04C 13/00*** | (2006.01) |
| ***F04C 15/00*** | (2006.01) |
| ***F04C 2/18*** | (2006.01) |
| ***F02M 37/04*** | (2006.01) |
| ***F04C 2/08*** | (2006.01) |
| ***F04C 2/14*** | (2006.01) |

(52) U.S. Cl.
CPC ..... *F04C 2/14* (2013.01); *F04C 2/18* (2013.01); *F04C 11/001* (2013.01); *F04C 11/006* (2013.01); *F04C 13/001* (2013.01); *F04C 15/0061* (2013.01); *F04D 13/12* (2013.01); *F04C 2210/1044* (2013.01); *F04C 2210/203* (2013.01); *F04C 2240/54* (2013.01); *F04C 2240/60* (2013.01)

(58) Field of Classification Search
CPC ..... F04C 15/0073; F04C 2240/54; F04C 13/001; F04C 13/002; F04C 29/023; F04C 23/005; F04D 13/12; F02M 37/041; F02M 37/045; F04B 41/06; F04B 23/08; F04B 23/12; F04B 23/14
USPC ..... 417/203, 201, 244, 313; 418/91, 94
See application file for complete search history.

(56) References Cited

U.S. PATENT DOCUMENTS

| | | | | | |
|---|---|---|---|---|---|
| 2,881,704 | A * | 4/1959 | Murray | F04C 15/0026 | 417/203 |
| 2,941,473 | A * | 6/1960 | Lorenz | F04D 13/02 | 417/203 |
| 2,955,536 | A * | 10/1960 | Gaubatz | F04B 23/12 | 417/203 |
| 2,955,537 | A * | 10/1960 | Gaubatz | F02C 7/22 | 415/122.1 |
| 2,957,418 | A * | 10/1960 | Edwards | F04B 23/12 | 417/203 |
| 2,961,970 | A * | 11/1960 | Murray | B64D 37/16 | 417/203 |
| 2,969,019 | A * | 1/1961 | Lorenz | B64D 37/16 | 210/131 |
| 3,026,929 | A * | 3/1962 | Burns | B64D 37/16 | 417/201 |
| 4,586,468 | A * | 5/1986 | Dzioba | B60T 17/02 | 123/198 C |
| 2010/0024778 | A1* | 2/2010 | Yates | F02C 7/236 | 123/495 |
| 2014/0338759 | A1* | 11/2014 | Neate | F04C 11/005 | 137/340 |

* cited by examiner

TWO STAGE PUMP, PARTICULARLY PROVIDED AS MAIN PUMP FOR SUPPLYING AN AIRCRAFT ENGINE WITH FUEL

The subject matter of the invention is a two stage pump, particularly provided as main pump for supplying an aircraft engine with fuel.

Aircraft engines include a main fuel pump, which is at the heart of their regulation system. It makes it possible to supply the combustion chamber with fuel, by pumping the necessary output from the tanks. The output that it delivers also serves as hydraulic fluid for actuating jacks, such as those serving to open the discharge ports of the air flow from the primary stream to the secondary stream of the engine.

This pump may comprise two stages, a low pressure pump and a high pressure pump. The two stages have a separate function: the first delivers a pressure rise at fixed output, the second an output at a pressure difference fixed at its boundaries. They are most often integrated in a same casing, for reasons of saving space and simplification of the engine, and constitute a single item of equipment, driven at the same speed by a same shaft.

The technology the most widely used at present for the low pressure stage is a centrifuge pump with bladed impeller. Such a pump has pressure raising characteristics which considerably depend on the rotation speed.

The technology the most widely used at present for the high pressure stage is a fixed displacement gear pump. Its output is thus proportional to its rotation speed, at more or less volume efficiency. This technology, used for its great reliability, implies a surplus of output pumped at certain flight regimes, where the rotation speed is high whereas there is no longer need of output, either to the injection in the combustion chamber, or to the actuators. This surplus output is then returned to the upstream of the high pressure pump.

The two stages of the pump are in general housed in a common casing. The two pumping stages are connected together by a connecting portion through which passes a drive shaft, and which is of markedly reduced section than the rest of the casing, in order to limit heat conduction from the high pressure stage, where the fluid is generally heated, to the low pressure stage.

Despite the compactness of the lay out, due in particular to the single casing, a volume saving of the pump, accompanied by a simplification of its structure by a reduction in the number of parts, is sought.

In the known design, the connecting portion of the casing contains one or more generally two bearings serving to support the drive shaft between the two stages, as well as stop devices limiting the axial movement of said bearing. It has been envisaged to eliminate these bearings to mount the corresponding portion of the drive shaft in cantilevered arrangement while making it support the rotating element of the low pressure pump, but this is difficult to achieve properly, since the corresponding loads are transmitted to the moving constituents of the high pressure pump and can prove to be excessive.

This is nevertheless achieved in the invention, by resorting to certain particular adjustment modifications of known designs.

The device according to the invention is a two stage pump of a kind known from the document U.S. Pat. No. 2,688,125 and including a first pump having a rotating pumping element, driven by a support shaft, a second pump including two pumping pinions meshing together, of which a driving pinion and a driven pinion, a drive shaft of the driving pinion and a transmission connecting the driving pinion to the support shaft and contained in the second pump, the support shaft being coaxial to the driven pinion.

According to the invention, the support shaft is partially contained in a reaming passing through the driven pinion, and a bearing of the support shaft is housed in the reaming passing through the driven pinion, between the support shaft and the driven pinion at the place of the teeth of the pinion. A considerable space saving may be made, since the volume of the reaming passing through the driven pinion is henceforth occupied by the support shaft which drives the first pump, instead of remaining simply filled with pumped fluid. The support shaft may extend essentially into the second pump, and the first pump may be brought closer to the second pump, by simplifying this connection and reducing its length. The pump design then becomes lighter and more compact. The radial load generated by the low pressure stage is communicated to the support bearings of the driven pinion through the intermediary of the support shaft and said bearing housed in the reaming. The location of said bearing within the reaming of the driven pinion can enable the radial loads stemming from the high pressure stage and the loads stemming from the low pressure stage to balance out between each other on the support bearings of the driven pinion and thereby to relieve them, instead of adding together as in the case of known designs. The bending of the axle of the driven pinion is thus reduced. The loads undergone by the driven pinion and by its bearings are thereby lightened, whereas the loads undergone by the driving pinion are markedly less important in known designs.

This bearing of the support shaft may be hydrodynamic, maintained by a re-circulation of the pumped fluid established in the reaming. It may comprise an axial stop, and the support shaft and the reaming are provided with radial projections having opposite flat or conical faces.

Another aspect of the invention is constituted of an assembly where the pump further includes a sealing gasket arranged around the support shaft, separating the pumping element of the first pump from the second pump. This gasket is in place of the known bearing and serves to isolate the pumping chambers, only allowing a leak flow of heated fluid towards the low pressure pump, but it can itself serve as hydrodynamic bearing to the support shaft.

The transmission may consist of a first toothed wheel and a second toothed wheel, respectively integral with the driving pinion and the support shaft and meshing together; such a transmission has the important advantage of making it possible to choose more or less freely the rotation speed ratio of the pumping elements.

These aspects of the invention, as well as others, will now be developed in relation to the detailed description of an embodiment of the invention that will now be made, this embodiment being given for purely illustrative purposes, by means of the following figures.

Figure 5:
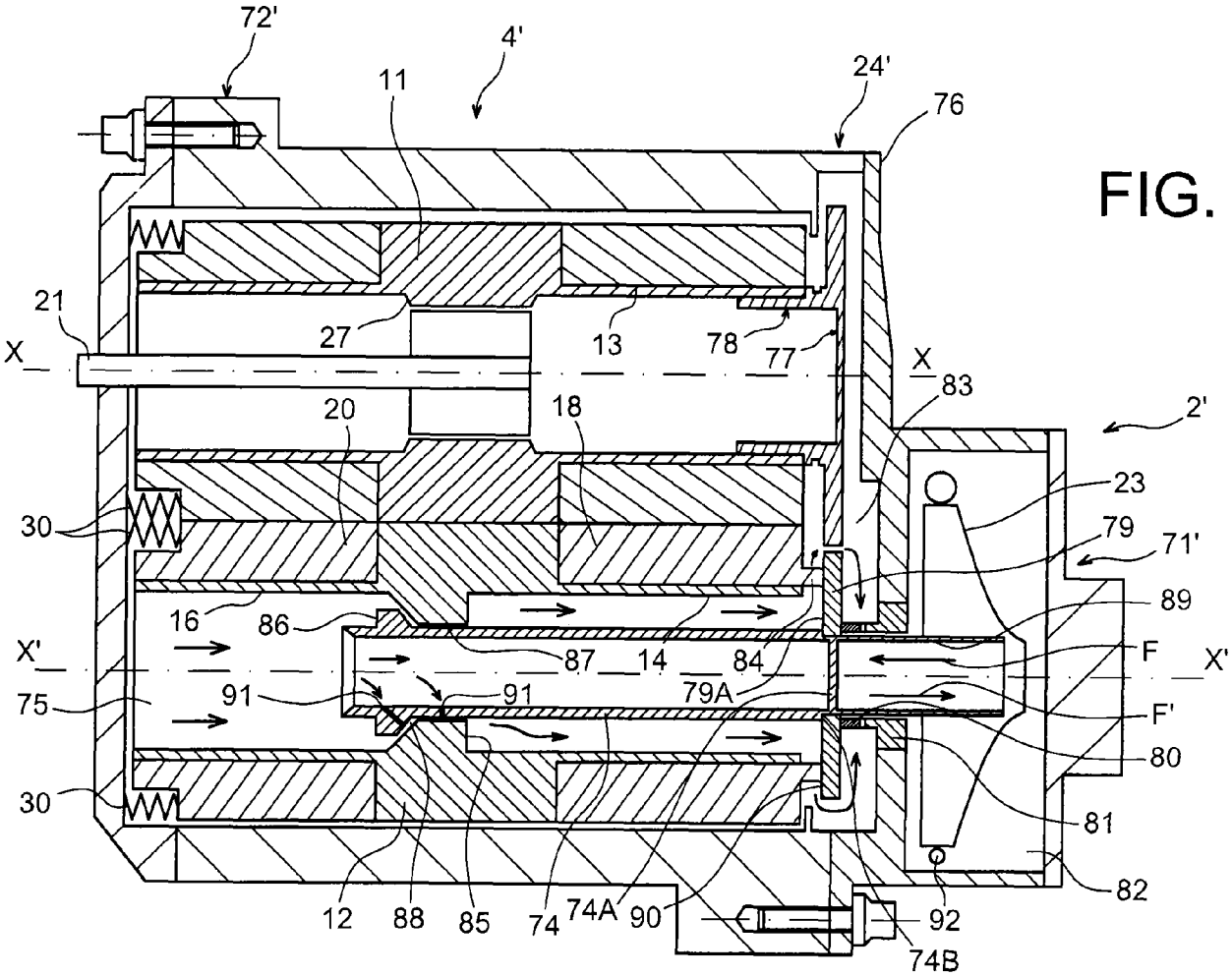

and FIG. 5 illustrates the modifications made by the invention.

The description of the first figures will now be made.

Figure 1:
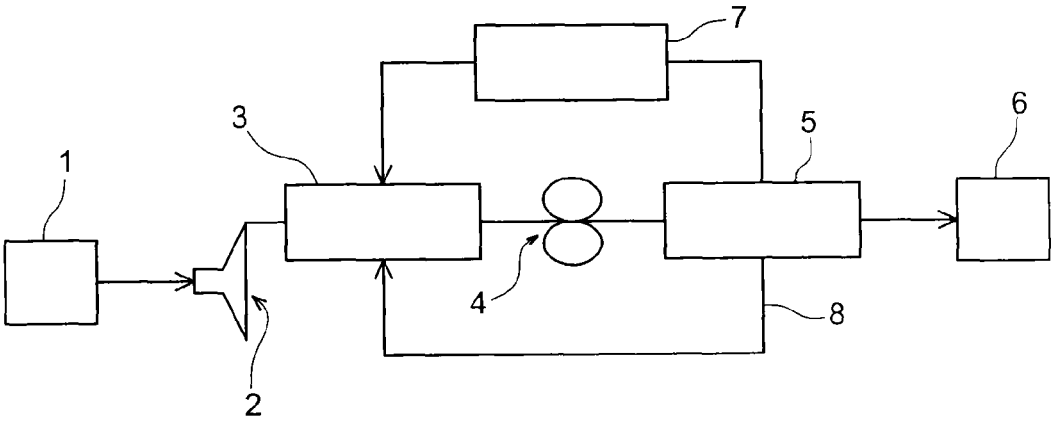
FIG. 1 is a circuit diagram comprising a two stage pump device.

FIG. 1 represents the engine fuel circuit. A tank 1 of an aircraft supplies a first low pressure pump 2, then, via filters and exchangers 3, a second high pressure pump 4. The pressurised fuel is supplied to a metering unit 5, which supplies a combustion chamber 6 of the actuators and servo-valves 7; the surplus output returns upstream of the high pressure pump 4 via a return pipe 8, and, similarly, the fluid used in the actuators and servo-valves 7.

Figure 2:
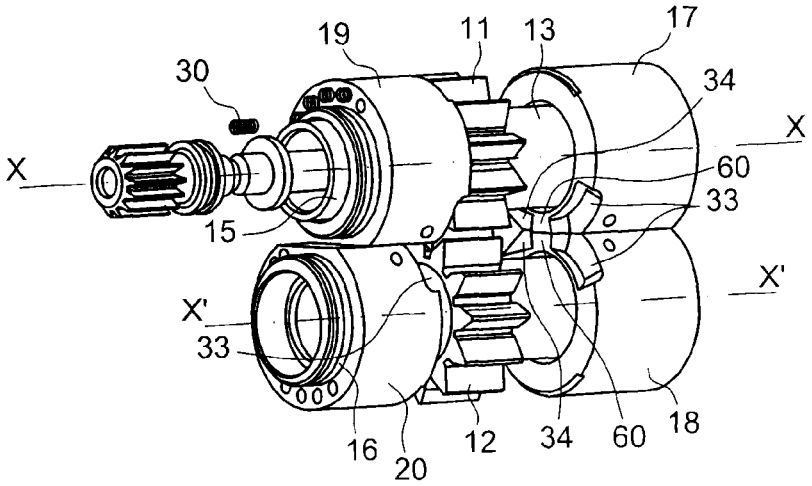
FIGS. 2 and 3 are various views of the high pressure pump that the invention perfects.
Figure 3:
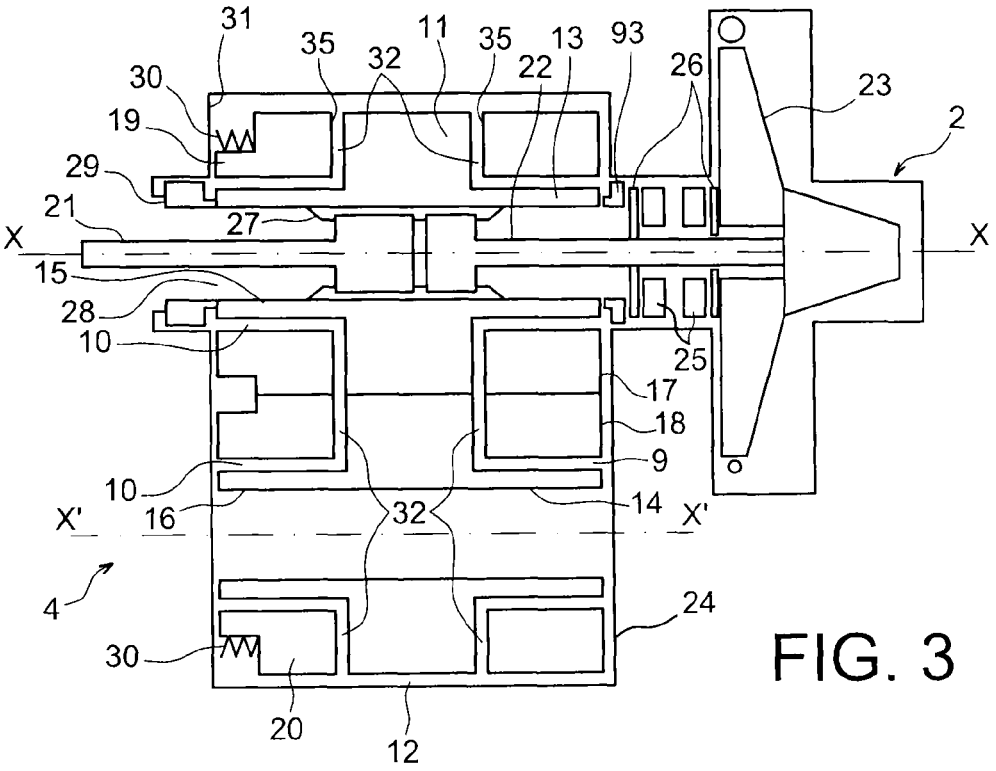

FIGS. 2 and 3 are now explained.

FIG. 2 illustrates, in perspective, the essential portions of the known high pressure pump 4 and which the invention must perfect, and FIG. 3 is a general plan of the device. The high pressure pump 4 is a gear pump, including a driving pinion 11 and a driven pinion 12, meshing together and forcing back the fuel from between their teeth to accomplish the pumping. Each of the pinions 11 and 12 includes tails or axle ends 13, 14 and 15, 16 at its two opposite ends, of which the first, on the right of FIGS. 2 and 3, are supported by respective first bearings 17, 18, called fixed bearings with first clearances 9, and the second, on the left in the figures, are supported by second bearings, called moving bearings 19, 20 with second clearances 10. The pinion 11, the axle ends 13, 15 and the bearings 17 and 19 extend along a longitudinal axis XX. The pinion 13, the axle ends 14, 16 and the bearings 18 and 20 extend along a longitudinal axis X'X' substantially parallel to XX. These bearings 17 to 20 are all smooth bearings, but the fixed bearings 17 and 18 are held with a smaller clearance in housings of a casing 24 than the moving bearings 19 and 20, which can thus move in the direction of their axis XX or X'X' to pinch the pinions 11 and 12 and reduce the clearances which could allow a re-circulation of the pumped fluid towards the low pressures. The driving pinion 11 is driven by a high pressure shaft 21, and a low pressure shaft 22 drives a pumping element such as an impeller 23 of the low pressure pump 2. The pumps 2 and 4 are both integrated in the common casing 24. The low pressure shaft 22 is supported by an additional bearing in a reaming of the casing 24. In known designs, this bearing may also be formed of two separate bearings 25. A dynamic sealing gasket 93 may also be incorporated between the bearing and the axle end 13. Stops 26 limit the axial movements of the impeller 23, while pressing on the bearings 25. The movement of the drive shaft 21 is communicated to the low pressure shaft 22 through the intermediary of flutings 27 between the driving pinion 11 and the ends of the shafts 21 and 22. A coupling of the pumps 2 and 4 is thereby obtained.

Figure 4:
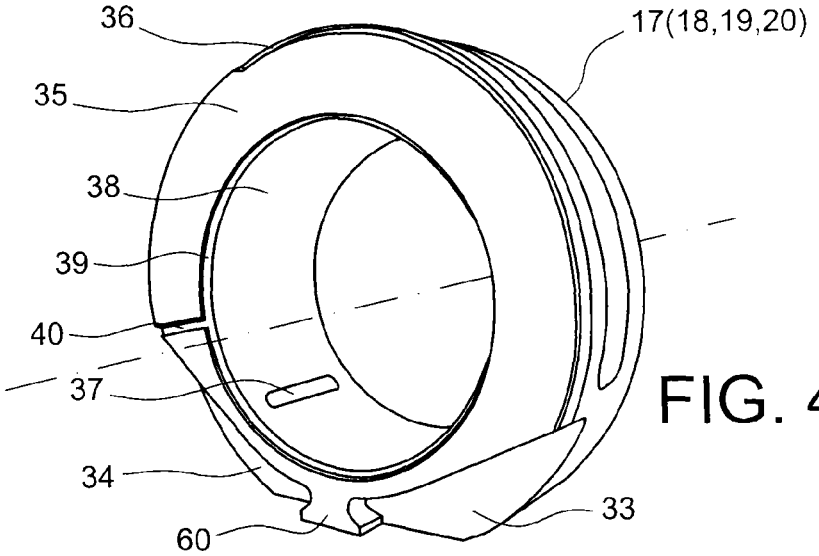
FIG. 4 represents a smooth bearing of a pinion of a high pressure pump.

The correct operation of the high pressure pump 4 depends on a sufficient sealing between its different elements: it is necessary to avoid leaks of the pumped fluid towards the exterior of the casing 24 and limit as much as possible re-circulation leaks, nevertheless inevitable, towards the inlet of the pump 4 around the pinions 11 and 12. The casing 24 is open in 28 around the inlet of the high pressure shaft 21. A sealing gasket 29 is arranged at this place, between the casing 24 and the adjacent axle end 15, to eliminate leaks towards the exterior. Leaks through re-circulation around the pinions 11 and 12 are minimised firstly by means of springs 30 compressed between the moving bearings 19 and 20 and a face 31 of the casing 24, adjacent to the inlet of the high pressure shaft 21, in order to push back the moving bearings 19 and 20 towards the pinions 11 and 12, and these towards the fixed bearings 17 and 18, thereby reducing the clearances 32 around the pinions 11 and 12 and while producing the pinching already mentioned; and by means of particularities of construction of the bearings 17 to 20 which will be described with FIG. 4.

Friction between the bearings 17 to 20 and the pinions 11 and 12 is avoided by fluid layers, maintained in a hydrodynamic manner. Each of the bearings 17 to 20 is hollowed out with several reliefs, of which a high pressure pan 33 and a low pressure pan 34 at the periphery of an inner axial face 35, on either side of a separating spoiler 60. The pans 33 and 34 are in respective communication with the volumes of fluids adjacent to the outlet and to the inlet of the pump 4. The high pressure pan 33 communicates with a high pressure arced groove 36, which emerges on the inner axial face 35, and, through the intermediary of a drilling not represented, to a high pressure groove 37, which emerges in an inner radial face 38 of the bearing 17 to 20. A low pressure groove 39 extends to the junction of the inner axial face 35 and the inner radial face 38 and communicates with the low pressure pan 34, via a collecting groove 40. In the bearings 17 to 20 constructed in this manner, the operation of the pump thus maintains a circulation of fluid used for the dynamic lubrication of the bearings 17 to 20, from the high pressure pan 33 to the low pressure pan 34, while creating hydrodynamic layers on the inner axial face 35 and the inner radial face 38. The axle ends 13 to 16 are thus supported by these hydrodynamic layers in the inner radial faces 38, which occupy the clearances 9 and 10, and the hydrodynamic layers on the inner axial faces 35 form against the sides of the pinions 11 and 12, while maintaining them slightly separated from the bearings 17 to 20 and thus preventing the complete elimination of the clearances 32, despite the springs 30.

Finally, the pressure difference between the inlet and the outlet of the pump exerts a radial resultant on the pinions 11 and 12, which brings them closer to the casing 24 at an inlet side of the fluid.

Thus, the chamber of the casing 24, occupied by the pinions 11 and 12 and the bearings 17 to 20, is the seat of very small leaks towards the exterior and reduced re-circulation leaks around the different surfaces of the pinions 11 and 12, which enables an acceptable operation of the high pressure pump 4. This is due above all to the differential pressure forces on the moving elements inside the casing 24 which are the pinions 11 and 12 and the moving bearings 19 and 20, since these differential pressure forces maintain the hydrodynamic layers supporting the axle ends 13 to 16 and the pinching of the pinions 11 and 12 between the bearings 17 to 20 with reduced clearances 32; the springs 30 which also contribute to this pinching are nevertheless useful only at the start up of the pump 4, when no pressure difference is yet created therein, since the loads that they produce are then much lower than the loads due to the pressure.

Reference is made to FIG. 5, which represents an embodiment of the invention drawn from the design of the preceding figures. The portions thereof which are maintained without change bear the same references. The low pressure pump hereafter bears the reference 2', the high pressure pump the reference 4' and the casing the reference 24'.

The impeller 23 of the low pressure pump 2' is henceforth driven by a hollow support shaft 74, arranged inside a reaming 75 passing through the driven pinion 12 and its axle ends 14 and 16. The support shaft 74 includes a leak tight internal partition 74A between the first and second pumps 2' and 4', arranged substantially radially with respect to the axis X'X' in its main part of the side of its end connected to the impeller 23. It also includes an external shoulder 74B arranged substantially opposite the partition 74A. The portions 71' and 72' of the casing 24', housing respectively the elements of the two pumps 2' and 4', are henceforth brought together by a casing flange 76, continuous except at the place the support shaft 74 goes through. The flange 76 separates the pumping element (the impeller 23) of the first pump 2' from the second pump 4'.

The transmission of movement, from the drive shaft 21, flutes 27 and the driving pinion 11, takes place as follows. A first toothed wheel 77 is integral with the axle end 13 of the driving pinion 11, which is the closest to the flange 76; it is integral with a sleeve 78, which is sunk into a reaming of the axle end 13 of the driving pinion 11 and screwed or brazed to it, which constitutes an assembly that is easy to produce and reliable. The first toothed wheel 77 meshes with a second toothed wheel 79, integral with the support shaft 74, fixed by a nut 80, which blocks it against the shoulder 74B of the support shaft 74. Since the connection with the support shaft 74 occurs without freedom of rotation, the movement of the axle end 13 is transmitted successively to the toothed wheels 77 and 79, then to the support shaft 74 and to the impeller 23.

The drilling of the flange 76 comprises a sealing gasket 81 arranged around the support shaft 74 between the flange 76, and which extends up to the nut 80. It may consist of a housing provided with a lip pushed back by a spring towards the nut 80, in order to maintain the contact thereon, despite possible small translation movements in the axis X'X' of the support shaft 74. This arrangement maintains the sealing between the respective chambers 82 and 83 of the pumps 2' and 4', separated by the flange 76 while minimising the re-circulation of fluid, which the bearing or the bearings 25 would not enable, and thus maintains transmissions of heat to the low pressure pump 2' at a very low level, despite the absence of the air knife at the junction of the parts of casing 71' and 72' consecutive to the elimination of the bearings 25.

The bearing 18 of the driven pinion 12 the closest to the flange 76 is provided with a stop crown 84 adapted to cooperate with a lateral face 79A of the second toothed wheel 79, face which is opposite to the flange 76. Finally, the driven pinion 12 is provided with a circular radial projection 85 on the inner reamed face, which narrows the reaming 75 in the main part, at the middle thereof. Yet the support shaft 74 is also provided with a circular radial projection 86 on its external face, at its end opposite to the impeller 23. The circular projections 85 and 86 are preferably opposite to each other and comprise facing faces, conical (but which could be flat, then losing the advantage of transforming the axial load of the stage of the low pressure pump 2' into an axial component and a radial component, which makes it possible to spread out the load to take up in this embodiment by the bearing 18 between its faces 35 and 38). The circular projection 85 has an internal diameter barely greater than that of the support shaft 74. Similarly, the sealing gasket 81 has an internal diameter barely greater than that of the support shaft 74, at the place where it passes through it. It results from this arrangement that a first hydrodynamic support bearing is formed between the support shaft 74 and the circular projection 85, which comprises a first hydrodynamic axial stop 88 formed at the conical interface between the circular radial projections 85 and 86, that a second hydrodynamic support bearing 89 is formed between the sealing gasket 81 and the support shaft 74, and that a second hydrodynamic axial stop 90 is formed between the respective elements of the support bearing 18 of the driven pinion 12 and the toothed wheel 19, in particular respectively the stop crown 84 and the face 79A of the second toothed wheel 79 which cooperate to form said stop.

The advantages and operating particularities of the invention will now be described in detail.

The mechanical drive loads of the impeller 23 do not go through the driven pinion 12, already more highly loaded by design of the stage corresponding to the high pressure pump 4', but through the driving pinion 11, which is less loaded since the mechanical and pressure loads are opposed whereas they are added together on the driven pinion 12, and through the toothed wheels 77 and 79.

The reaming 75 being occupied only by the support shaft 74, more design freedom is available for arranging the first bearing 87 at the centre of the reaming 75, at the place of the cogs of the driven pinion 12, where the additional loads communicated to the driven pinion 12 by the stage of the low pressure pump 2' in this embodiment, will be easier to take up correctly in an ingenious manner, and particularly without imbalance of load on the bearings 18 and 20, while stiffening the driven pinion 12 usually subject to bending deformation of its axle.

The hydrodynamic axial stops 88 and 90 enable small movements of the support shaft 74 in the axis X'X', but which are limited.

Since the axial stops 88 and 90, and the bearings 87 and 89, are hydrodynamic and integrated with the rest of the structure, they make it possible to avoid resorting to cumbersome mechanical elements. They are maintained by the fluid pumped under pressure for which a re-circulation is organised via the reaming 75, along the arrows oriented from the part of the reaming 75 opposite to the flange 76 towards the second toothed wheel 79. This output flows into the axial stop 88 and the bearing 87. Emerging drillings 91 are established substantially radially in the projection 86 and through the support shaft 74 facing the support interface of the projection 85 and the shaft 74, in order to enable the circulation of fluid in the reaming 75 from the part of the reaming 75 opposite to the flange 76 towards the latter while going through the internal part of the support shaft 74 and the external part of the support shaft 74, and to contribute to the lubrication of the axial stop 88 and the bearing 87. The lubrication of the toothed wheels 77 and 79 is thus assured.

The second bearing 89 reduces the cantilever of the support shaft 74 and makes it possible to support it partially by the casing 24'.

The lubrication of the second axial stop 90 and the toothed wheels 77 and 79 is assured by the same flow, which then re-joins the chamber portion 83 adjacent to the flange 76. The lubrication fluid being the fluid of the high pressure pump 4', it has gone through a filter (not represented), generally present through the flow, between the pumps 2' and 4', such that it contains fewer impurities and assures a lubrication of good quality, less risking causing damage. And the lubrication of the second bearing 89 is assured by a re-circulation of fluid from the chamber 82 of the low pressure pump 2'.

A remarkable effect of the invention will now be described. The axial resultant of load F on the impeller 23 is oriented towards the left of FIG. 5, that is to say towards the high pressure pump 4', at start up, which makes the second toothed wheel 79 exert a compression load on the stack constituted by the bearings 18 and 20 and the driven pinion 12, completing the action of the springs 30, which may then be chosen less powerful. The clearances 32 around the driven pinion 12 are reduced during this start up period by the face F, and the re-circulations of fluid are also reduced. Nevertheless, it is observed that the load F' on the impeller 23 is reversed at full speed; the impeller 23 is then retained by the hydrodynamic stop 88, and the pinching of the driven pinion 12 between the bearings 18 and 20, which limits re-circulations, is then assured by the higher pressure of the surrounding fluid.

The impeller 23 of the low pressure pump 2' is completed by a fluid outlet volute 92. Advantageously, a volute 92 of changing shape is chosen, which may have the property that the force resultant, that it exerts on the impeller 23 and the support shaft 74, is of constant orientation. It is then recommended to choose the orientation of the volute 92 such that said load is always directed towards the driving pinion 11.

Since gear pumps are the seat of a radial load of constant orientation from the driving pinion 11 to the driven pinion 12 due to their meshing and the pressure of the fluid, a judicious orientation of the volute 92 makes it possible to exert an antagonistic load on the driven pinion 12 by the support shaft 74 and the hydrodynamic bearing 87, with the effect of reducing the resultant force on the driven pinion 12 and of relieving the bearings 18 and 20.

The gear ratio of the toothed wheels 77 and 79 is chosen to offer the desired rotation speed to the impeller 23, according to the speeds of the pinions 11 and 12.

The separation of the pumping chambers 82 and 83 of the pumps 2' and 4' by the single flange 76 adds to the simplification of the structure, to the reduction of its size, and to its lightening. These advantages, particularly sought with the invention, are reinforced by most of the other characteristics of the embodiment described, in particular thanks to the simplification of the bearings and to the reduction of internal loads, which makes it possible to reduce the weight of the elements that they are subjected to.

The invention claimed is:

1. Two stage pump including a first pump having a rotating pumping element driven by a support shaft, a second pump including two pumping pinions meshing together, the two pumping pinions including a driving pinion and a driven pinion, a drive shaft of the driving pinion extending along a longitudinal axis, and a transmission connecting the driving pinion to the support shaft, the transmission being contained in the second pump, the support shaft being coaxial to the driven pinion, wherein the support shaft is partially contained in a reaming passing through the driven pinion, and in that it comprises a first bearing supporting the support shaft in the reaming, formed between the support shaft and the driven pinion.

2. Two stage pump according to claim 1, wherein the first bearing comprises a first axial stop, and the support shaft and the reaming are provided with radial projections having opposite faces that are either flat, or, preferably, conical.

3. Two stage pump according to claim 2, wherein the first axial stop is hydrodynamic and maintained by re-circulations of a fluid pumped in one of the two pumps.

4. Two stage pump according to claim 1, wherein it includes a sealing gasket arranged around the support shaft, separating the pumping element of the first pump from the second pump, the sealing gasket forming a second bearing supporting the support shaft.

5. Two stage pump according to claim 4, wherein the second bearing is hydrodynamic and maintained by re-circulations of a fluid pumped in one of the two pumps.

6. Two stage pump according to claim 4, wherein the transmission consists of a first toothed wheel and a second toothed wheel, respectively integral with the driving pinion and the support shaft and meshing together.

7. Two stage pump according to claim 6, wherein the sealing gasket is arranged between a flange of a casing of the two stage pump and the second toothed wheel, the flange separating respective chambers of the first pump and the second pump.

8. Two stage pump according to claim 1, wherein the transmission consists of a first toothed wheel and a second toothed wheel, respectively integral with the driving pinion and the support shaft and meshing together.

9. Two stage pump according to claim 8, wherein the second toothed wheel and a support bearing of the driven pinion have respective elements which cooperate to form a second axial stop.

10. Two stage pump according to claim 9, wherein the second axial stop is hydrodynamic and maintained by re-circulations of a fluid pumped in one of the two pumps.

11. Two stage pump according to claim 8, whrein the transmission further includes a sleeve integral with the first toothed wheel and sunk into a reaming of the driving pinion.

12. Two stage pump according to claim 1, wherein the first bearing is hydrodynamic and maintained by re-circulations of a fluid pumped in one of the two pumps.

13. Two stage pump according to claim 1, wherein the rotating pumping element includes a fluid outlet volute of changing shape, which is arranged so as to exert on the support shaft a load of constant orientation towards the driving pinion.

* * * * *